US007585124B2

(12) United States Patent
Kawaguchi

(10) Patent No.: US 7,585,124 B2
(45) Date of Patent: Sep. 8, 2009

(54) ARMATURE STRUCTURE AND DOT HEAD

(75) Inventor: Takahiro Kawaguchi, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 535 days.

(21) Appl. No.: 11/369,153

(22) Filed: Mar. 6, 2006

(65) Prior Publication Data

US 2007/0081843 A1 Apr. 12, 2007

(30) Foreign Application Priority Data

Oct. 6, 2005 (JP) ..... 2005-293682

(51) Int. Cl.
*B41J 2/275* (2006.01)

(52) U.S. Cl. ..... 400/124.23; 400/124.11

(58) Field of Classification Search ..... None
See application file for complete search history.

(56) References Cited

U.S. PATENT DOCUMENTS

| | | | | |
|---|---|---|---|---|
| 2,419,862 | A * | 4/1947 | Wales | 83/23 |
| 5,205,659 | A * | 4/1993 | Gugel et al. | 400/124.23 |
| 5,290,112 | A * | 3/1994 | Stempfle et al. | 400/124.23 |
| 6,682,233 | B2 | 1/2004 | Terao et al. | |
| 6,698,956 | B1 | 3/2004 | Terao et al. | |
| 6,729,782 | B2 | 5/2004 | Ichitani et al. | |
| 6,784,907 | B2 | 8/2004 | Terao et al. | |
| 6,789,964 | B2 | 9/2004 | Kawaguchi | |
| 6,848,843 | B1 | 2/2005 | Kawaguchi | |
| 6,872,016 | B2 | 3/2005 | Kawaguchi | |
| 6,994,482 | B2 | 2/2006 | Terao et al. | |
| 7,008,126 | B2 | 3/2006 | Kawaguchi | |
| 7,018,116 | B2 | 3/2006 | Tsuchiya et al. | |
| 7,048,455 | B2 | 5/2006 | Kawaguchi et al. | |
| 7,172,351 | B2 * | 2/2007 | Kawaguchi | 400/124.23 |
| 2003/0012590 | A1 | 1/2003 | Terao et al. | |

(Continued)

FOREIGN PATENT DOCUMENTS

JP 61171359 A * 8/1986

(Continued)

OTHER PUBLICATIONS

U.S. Appl. No. 11/369,154; filed Mar. 6, 2006; Inventor: Takahiro Kawaguchi; title: Dot Head and Method of Manufacturing Armature Structure for Dot Head.

(Continued)

*Primary Examiner*—Daniel J Colilla
(74) *Attorney, Agent, or Firm*—Frishauf, Holtz, Goodman & Chick, P.C.

(57) ABSTRACT

An armature structure according to the present invention is arranged in a manner that two armature members, in each of which a shear plane and a broken-out section are formed by a punching processing on an inner periphery of a through hole into which a fulcrum shaft fits, are joined integrally in a state of sandwiching an arm therebetween so as to position the broken-out sections of the armature members at the outer side. Thus, even by the rotation of the armature structure during a printing operation, there does not arise a problem that the armature structure inclines due to eccentric wear, so that a stable printing state can be obtained for a long term.

2 Claims, 3 Drawing Sheets

U.S. PATENT DOCUMENTS

| | | | |
|---|---|---|---|
| 2005/0058488 | A1 | 3/2005 | Kawaguchi |
| 2005/0160576 | A1 | 7/2005 | Kawaguchi |
| 2005/0201797 | A1 | 9/2005 | Kawaguchi et al. |
| 2005/0201800 | A1 | 9/2005 | Tsuchiya et al. |
| 2005/0201801 | A1 | 9/2005 | Kawaguchi et al. |
| 2005/0207814 | A1 | 9/2005 | Kawaguchi |
| 2005/0207815 | A1 | 9/2005 | Terao et al. |
| 2005/0214052 | A1 | 9/2005 | Kawaguchi et al. |
| 2007/0065211 | A1 | 3/2007 | Kawaguchi |
| 2007/0065212 | A1 | 3/2007 | Kawaguchi |

FOREIGN PATENT DOCUMENTS

| | | | | |
|---|---|---|---|---|
| JP | 5521 | A | | 1/1993 |
| JP | 5-318779 | A | | 12/1993 |
| JP | 6-286168 | A | | 10/1994 |
| JP | 7-256898 | A | | 10/1995 |
| JP | 7-309022 | A | | 11/1995 |
| JP | 9-314868 | A | | 12/1997 |
| JP | 2000-249166 | A | | 9/2000 |
| JP | 2001-219586 | A | | 8/2001 |
| JP | 2004237681 | A | * | 8/2004 |
| JP | 2005-075000 | A | | 3/2005 |
| JP | 2005-75000 | A | | 3/2005 |

OTHER PUBLICATIONS

U.S. Appl. No. 11/369,156; filed Mar. 6, 2006; Inventor: Takahiro Kawaguchi; title: Armature Damper, Method of Manufacturing Armature Damper, and Dot Head.

* cited by examiner

ARMATURE STRUCTURE AND DOT HEAD

CROSS-REFERENCE TO RELATED APPLICATION

This application is based upon and claims the benefit of priority from prior Japanese Patent Application No. 2005-293682 filed on Oct. 6, 2005, the entire contents of which are incorporated herein by reference.

BACKGROUND OF THE INVENTION

1. Field of the Invention

The present invention relates to an armature structure for driving a printing wire and a dot head used in a wire dot printer.

2. Description of the Related Art

The wire dot printer is arranged to move a printing wire (hereinafter, simply referred to as a wire) called a needle forward and backward to strike the tip end of the wire against a print medium thereby to print a dot-shaped image thereon. Since the wire dot printer employs such the printing method, the wire dot printer can simultaneously print plural slips etc. in a stacked state and so is employed for business use. Although there are various kinds of methods as the printing method of moving the wire (needle) forward and backward, the method called a clapper type is generally employed. The clapper type has been employed widely since the structure thereof is simple and a relatively long stroke can be secured. Such the kind of the printing method is proposed by JP-A-2005-75000, for example.

The dot head of such the clapper type includes a plurality of armature structures each for driving a corresponding printing wire backward and forward. The armature structure is configured in a manner that an arm having a printing needle attached to a tip end thereof is integrated with an armature which is driven magnetically. Each of the arm and the armature is provided at the base end thereof with a through hole into which a fulcrum shaft is inserted. The arm rotates around the fulcrum shaft when the armature is attracted magnetically, whereby the tip end of a needle provided at the tip end of the arm collides with a print medium to perform the printing.

In order to realize a high-speed printing, the armature structure is required to be light-weighted and have a high magnetic efficiency. To this end, the armature is formed by iron-cobalt alloy which is excellent in magnetic characteristics. The iron-cobalt alloy is excellent in magnetic characteristics but has a nature that it is hard and fragile. In the case of manufacturing the armature, the punching processing using the press processing is utilized thereby to form the armature in a predetermined shape. In this case, when the hard and fragile iron-cobalt alloy is subject to the punching processing using the press processing, a shear plane A and a broken-out section B are formed on the pressed end face in the thickness direction thereof as shown in FIG. 1.

For example, when the armature with a thickness of 0.80 mm is subjected to the punching processing, a ratio between the shear plane A and the broken-out section B becomes almost 50% (that is, each of the shear plane and the broken-out section becomes 0.40 mm). Of course, when a clearance between a male die and a female die for the punching processing is made small, a ratio of the shear plane A can be made large. However, since the material to be punched is hard, the punching dies may be broken when the clearance is made too small. It is difficult to increase the ratio of the share plane to almost 50% or more in view of the productivity.

The aforesaid shear plane A and the broken-out section B appear in the thickness direction also at the inner periphery of the through hole in which the fulcrum shaft of the armature fits. The armature structure rotates at a high printing frequency of 2500 Hz around the fulcrum shaft at the time of the printing operation. Thus, the inner periphery of the through hole of the armature is worn away due to the contact with the fulcrum shaft. An amount of the abrasion differs between the hear plane A and the broken-out section B, so that there arises the eccentric wear and so the armature structure inclines. Due to the inclination of the armature structure, the needle attached to the tip end of the arm is applied with a stress in the transverse direction, so that the durability performance of the arm is badly influenced by the stress.

SUMMARY OF THE INVENTION

An object of the invention is to provide an armature structure and a dot head which can print stably for a long term without causing the inclination of the armature structure due to the eccentric wear of a through hole at the time of printing.

According to an embodiment of the invention, an armature structure including:

an arm at which a through hole into which a fulcrum shaft fits is formed near one end thereof; and two armature members at each of which a through hole common to the through hole of the arm is formed by a punching processing, a shear plane and a broken-out section being formed by the punching processing in an axial direction on an inner periphery of the through hole formed by the punching processing at each of the two armature members, and the two armature members being integrally joined to front and rear surfaces of the arm respectively so as to sandwich the arm therebetween in a manner that the shear planes are positioned at an outer side and the broken-out sections are positioned at an inner side.

Further, according to the embodiment of the invention, a dot head including:

an armature structure including: an arm provided with a through hole near one end thereof into which a fulcrum shaft fits and attached with a printing needle at a tip end thereof; and two armature members at each of which a through hole common to the through hole of the arm is formed by a punching processing, a shear plane and a broken-out section being formed by the punching processing in an axial direction on an inner periphery of the through hole formed by the punching processing at each of the two armature members, and the two armature members being integrally joined to front and rear surfaces of the arm respectively so as to sandwich the arm therebetween in a manner that the shear planes are positioned at an outer side and the broken-out sections are positioned at an inner side;

a fulcrum shaft which fits into the common through holes of the armature structure to support the armature structure so as to be rotatable; and a core which acts magnetic force on the armature structure to rotate the armature structure around the fulcrum shaft by the magnetic force thereby to collide a tip end of the needle attached to the tip end of the arm with a printing medium.

DETAILED DESCRIPTION OF THE INVENTION

An embodiment of the invention will be explained in detail with reference to the accompanying drawings.

Figure 2:
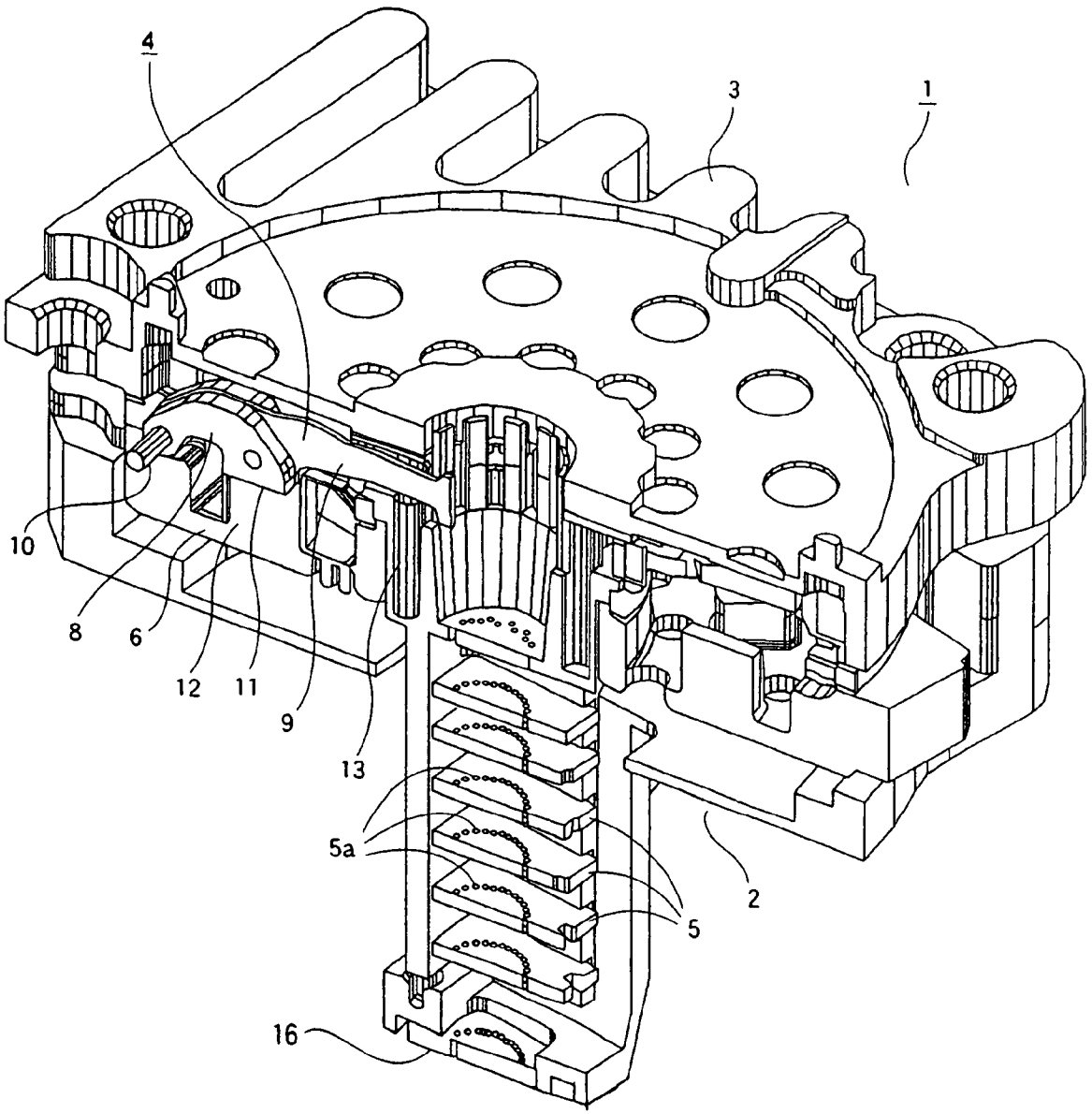
FIG. 2 is a perspective sectional view schematically showing a dot head according to an embodiment of the invention, in which the dot head is cut longitudinally along the center portion thereof.

First, the explanation will be made with reference to FIG. 2 as to the entire configuration of the dot head of a wire dot printer. FIG. 2 is a perspective sectional view schematically showing the dot head 1, in which the dot head is cut longitudinally along the center portion thereof.

The dot head 1 includes a front casing 2 and a rear casing 3 which are coupled by attachment screws (not shown). Armature structures 4, wire (needle) guides 5 and yokes 6 etc. are provided between the front casing and the rear casing.

The armature structure 4 includes an armature 8 and an arm 9 extended from the free end (the right end in the figure) of the armature 8. The armature 8 is provided with a fulcrum shaft 10 near the one end (the left end in the figure) thereof so as to be rotatable around the fulcrum shaft 10 in a manner that the tip end of the arm 9 moves in an arc manner. An attracted portion 11 is formed at the side portion (the lower surface in the figure) between the fulcrum shaft and the free end (the right end in the figure) of the armature 8. The attracted portion 11 opposes to a core 12 which is integrally provided with the yoke 6. That is, the yoke 6 is formed in an annular shape (doughnut shape) along the inner peripheries of the casings 2 and 3. The core 12 is integrally formed on the upper surface of the yoke 6 so as to oppose to the attracted portion 11 of corresponding one of the armatures 8.

A plurality of the armature structures 4 are disposed radially with respect to the axle center of the annular-shaped yoke 6. Each of the armature structures 4 is supported on the upper surface of the yoke 6 in a state that the free end side thereof rotates freely around the fulcrum shaft 10 in the direction away from the yoke 6. Further, the armature structure is biased in the direction (the upper direction in the figure) away from the yoke 6 by a not-shown spring within a cylindrical member 13 disposed vertically at the lower portion near the tip end of the arm 9.

A not-shown coil is wound around the core 12. When a current is supplied to the coil, magnetic field is generated to attract the attracted portion 11 of the armature 8. Thus, the armature 8 and the arm 9 integrally provided with the armature rotate clockwise in the figure around the fulcrum shaft 10.

A not-shown printing wire (needle) is attached by the hard soldering to the tip end of the arm 9 in the longitudinal direction thereof. The wire is attached downward in the figure so that the axial direction thereof crosses with the longitudinal direction of the arm 9.

Thus, when the armature 8 and the arm 9 integrally provided with the armature rotate clockwise in the figure around the fulcrum shaft 10 by the magnetic force generated by the core 12, the not-shown wire provided at the tip end of the arm 9 moves forward, that is, in the downward direction in the figure to the position where the tip end of the wire collides with a print medium such a print sheet. When the magnetic force having been generated by the core 12 disappears, the arm moves backward, that is, in the upward direction in the figure by the repulsive force of the not-shown spring within the cylindrical member 13.

The wire guide 5 includes guide holes 5*a* through which not-shown wires pass so as to guide the wires forward and backward freely so that the tip end of each of the wires collides with a predetermined position of a print medium. The front casing 2 is provided with a tip end guide 16 which lines up the tip ends of the wires in a predetermined pattern and guides the wires forward and backward freely.

Figure 3:
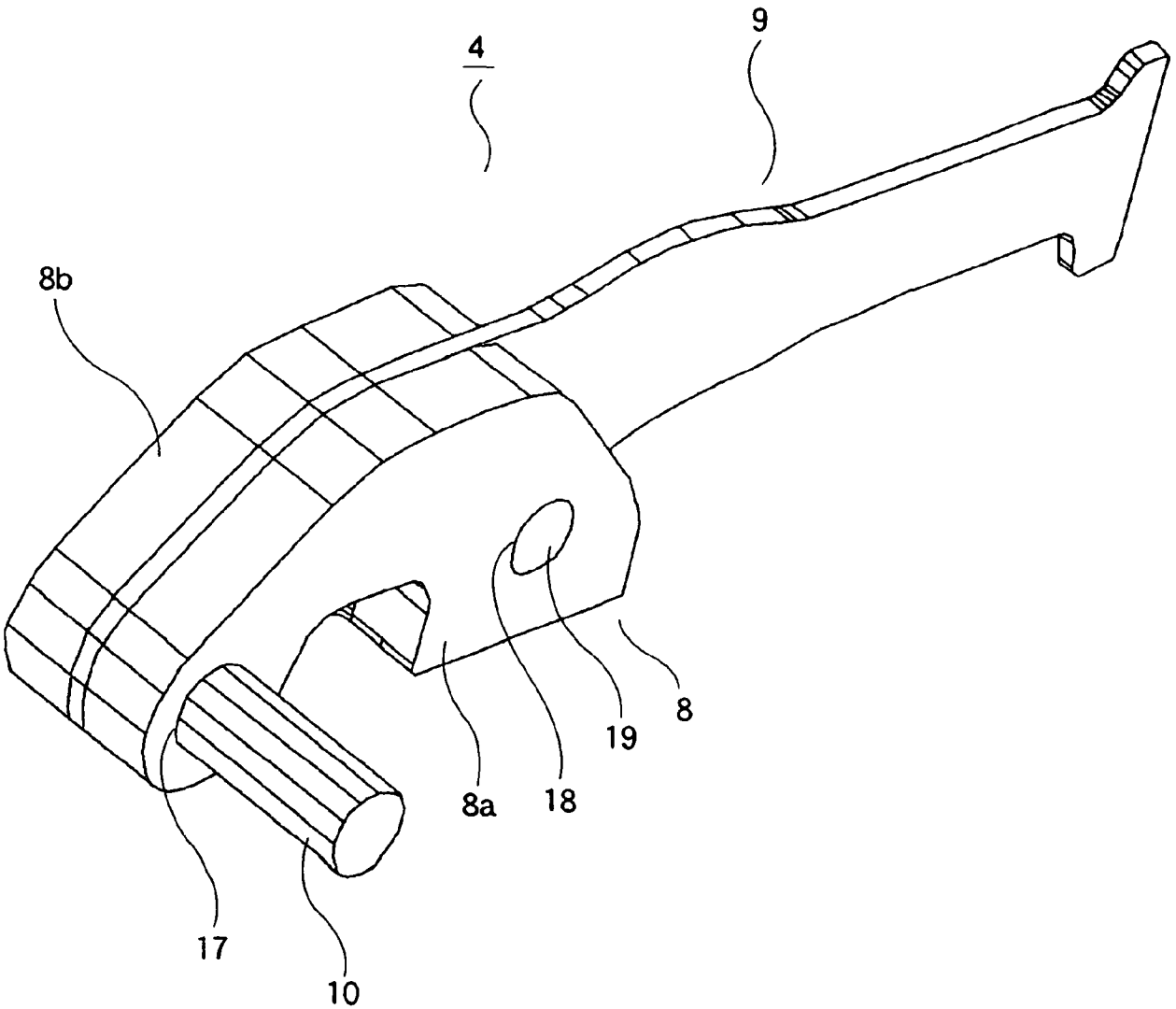
FIG. 3 is a perspective view showing an armature structure according to the embodiment of the invention.

Next, the armature structure 4 will be explained with reference to FIG. 3. As described above, the armature structure 4 is formed by integrating two armature members 8*a* and 8*b* and the arm 9. Each of the armature members 8*a* and 8*b* is formed by a sheet-shaped material excellent in magnetic characteristics such as iron-cobalt alloy (49Co-2V-49Fe) and the surface thereof is plated by using boron etc.

The arm 9 is sandwiched between the two armature members 8*a* and 8*b* in a stacked manner at the portion on the base end side thereof. Each of the two armature members 8*a* and 8*b* and the arm 9 is provided with a common through hole 17 at the portion near the left end thereof in the figure so that the fulcrum shaft 10 penetrates these common holes in the stacked state of the two armature members and the arm. A through hole 18 common to the two armature members 8*a* and 8*b* and the arm 9 thus stacked is provided for the provisional assembling at a portion near the right end of the armature 8 in the figure. A pin 19 is pressed with a small pressure into the through holes 18 for the provisional assembling thereby to provisionally assembling the armatures and the arm. A high-intensity piano wire which surface is subjected to the plating processing using boron etc. is used as the pin 19.

The armature structure 4 is required to have durability that it can withstand the reciprocative movement for about three hundred million strokes or more. Thus, each of the armature members 8*a* and 8*b* is subjected to the nitriding processing so as to have a hardened layer with a surface hardness of Hv 400 or more at an inner portion of the part (the depth is almost in a range of 5 μm to 10 μm).

The armature structure 4, thus provisionally assembled by sandwiching the part of the arm member 9 between the armature members 8*a* and 8*b* from the both sides thereof in a stacked manner and by inserting the pin 19 into the through holes 18 with a small pressure, is subjected to the spot welding thereby to melt and harden the plated portions by using boron etc. to integrate these armature members and the arm.

Figure 1:
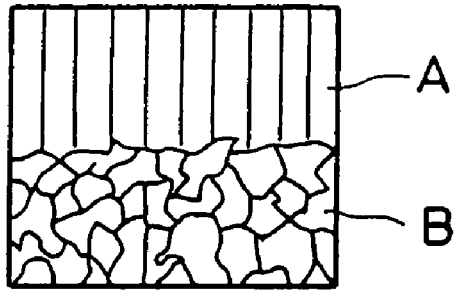
FIG. 1 is a diagram showing a shear plane and a broken-out section caused by a punching processing.

Since the two armature members 8*a* and 8*b* are formed by punching a plate-shaped material of iron-cobalt alloy which is excellent in magnetic characteristics by the press processing, as described above. In this case, as described above, since the iron-cobalt alloy is hard and fragile, a shear plane A and a broken-out section B are formed on the pressed end face of the punched part in the thickness direction thereof as shown in FIG. 1. The shear plane A and the broken-out section B appear not only at the inner periphery of the through hones 17 in which the fulcrum shaft 10 fits but also in the axial direction thereof.

The shear plane A has a relatively smooth processed surface and the opened edge thereof has a smooth circular shape. In contrast, since the broken-out section B is placed in such a state that the material is ripped off, the broken-out section has a relatively rough processed surface and so the opened edge thereof has an uneven circular shape. Further, the broken-out section has an inner diameter slightly larger than that of the shear plane.

Figure 4:
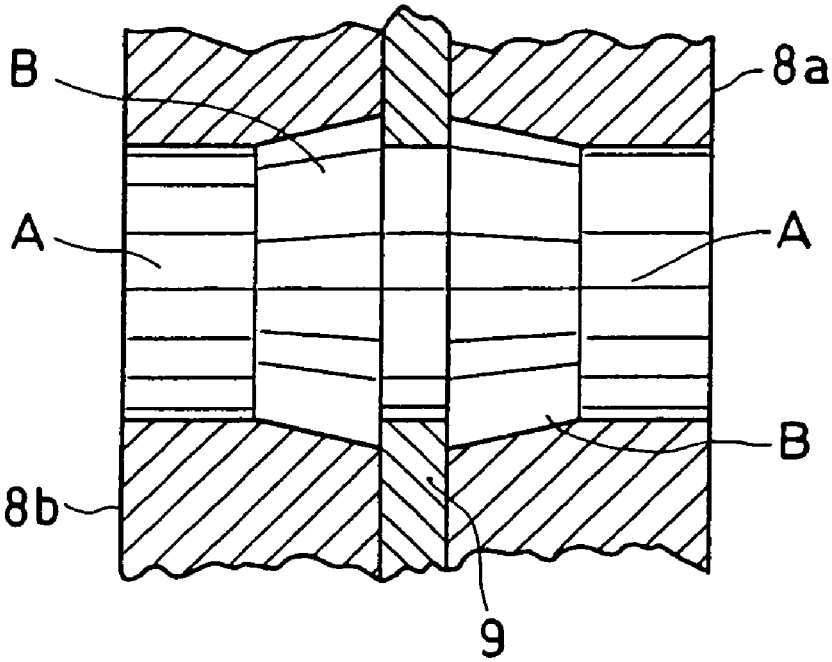
FIG. 4 is a sectional view showing a part of through holes in an assembled configuration of armature members and an arm according to the embodiment of the invention.

In view of the aforesaid fact, in the case of assembling the two armature members 8*a* and 8*b* with the arm 9, the two armature members 8*a* and 8*b* are stacked in the following manner. That is, the two armature members 8*a* and 8*b* are stacked in a manner that, as to the shear plane A and the broken-out section B which are formed at the inner peripheries of the through holes 17, 17 of the armatures 8*a*, 8*b*, the shear planes A are positioned at the outer side and the broken-out sections B are positioned at the inner side sandwiching the arm 9, as shown in FIG. 4. As to the two armature members 8*a* and 8*b* and the arm 9 thus stacked, a pair of welding electrodes are made in contact from the opposite outer sides of the armature members 8*a* and 8*b* to perform the spot welding thereby to integrate the armature members and the arm.

As explained with reference to FIGS. 2 and 3, at the time of the printing operation, the armature structure 4 configured in this manner rotates reciprocatively around the fulcrum shaft 10 fitting into the through holes 17 for about three hundred million strokes or more at a high printing frequency of 2,500 Hz. Thus, the inner peripheral surfaces of the through holes 17 in which the fulcrum shaft 10 fits are worn away. Since the armature structure 4 rotates in a predetermined angular range, the abrasion appears remarkably at the upper and lower portions in the figure of the inner peripheries of the through holes 17. Further, the shear plane A and the broken-out section B exist in the axial direction (transverse direction in the figure) at the inner peripheries of the through holes 17, and the surface state and the inner diameter differ between the shear plane and the broken-out section, so that the abrasion due to the fulcrum shaft 10 also differ between the shear plane and the broken-out section.

According to the invention, the two armature members 8*a* and 8*b* are assembled in a manner that the shear planes A formed at the inner peripheries of the through holes 17, 17 are positioned at the outer side and the broken-out sections B are positioned at the inner side sandwiching the arm 9, so that the inner peripheral surfaces of the left and right armature members 8*a* and 8*b* are equally worn away. That is, due to the rotating operation, at the inner peripheries of the through holes 17, the protruded tip portions of the shear planes A each having a relatively small diameter and the broken-out sections B each having the rough surface contact to the outer periphery of the fulcrum shaft 10 and are worn away. In this case, since the shear planes A, A, disposed at the both outer sides and each having the relatively small diameter and the smooth surface, mainly support the outer periphery of the fulcrum shaft 10, there does not arise the difference of the abrasion amount between the left and the right armature members and so they are equally worn away.

When the abrasion advances, the entirety of the broken-out sections B gradually contact to the outer periphery of the fulcrum shaft 10 and so a stress during the printing operation is reduced. In general, the abrasion between the shaft and the fitting hole has a tendency that when the abrasion at the initial stage of the operation advances to some degree and the contact area between the shaft and the fitting hole increases (the abrasion advances), the advancing speed of the abrasion becomes low and so the shaft supporting state becomes stable. As a result, unlike the conventional technique, there does not arise a problem that the armature structure 4 inclines due to the eccentric wear, so that the stable printing state can be obtained for a long term.

Further, since the broken-out sections B are positioned at the inner side, spaces are formed between the outer periphery of the fulcrum shaft 10 and the broken-out sections, so that lubricating oil can be contained at the spaces advantageously.

As described above, the two armature members 8*a* and 8*b* are assembled to sandwich the arm 9 therebetween and joined integrally in a manner that the shear planes A formed at the inner peripheries of the through holes 17, 17 are positioned at the outer side, there does not arise a problem that the armature structure 4 inclines due to the eccentric wear, so that the stable printing state can be obtained for a long term.

What is claimed is:

1. An armature structure comprising:

an arm in which a through hole is formed near one end thereof; and two armature members each of which has a through hole common to the through hole of the arm, wherein the through hole in each of the two armature members is formed by a punching processing and a shear plane and a broken-out section are formed by the punching processing in an axial direction on an inner periphery of the through hole in each of the two armature members, wherein the shear plane and broken-out section formed in the two armature members are symmetric to each other, and wherein the two armature members are integrally joined to front and rear surfaces of the arm respectively so as to sandwich the arm therebetween in a manner so that the shear planes are positioned on an outer side and the broken-out sections are positioned on an inner side of the two armature members; and a fulcrum shaft which fits into the common through holes and integrally joins the arm and the two armature members.

2. A dot head comprising:

an armature structure including:

(i) an arm provided with a through hole near one end thereof and attached with a printing needle at a tip end thereof;

(ii) two armature members each of which has a through hole_common to the through hole of the arm, wherein the through hole in each of the two armature members is formed by a punching processing and a shear plane and a broken-out section are formed by the punching processing in an axial direction on an inner periphery of the through hole in each of the two armature members, wherein the shear plane and broken-out section formed in the two armature members are symmetric to each other, and wherein the two armature members are integrally joined to front and rear surfaces of the arm respectively so as to sandwich the arm therebetween in a manner so that the shear planes are positioned on an outer side and the broken-out sections are positioned on an inner side of the two armature members; and (iii) a fulcrum shaft which fits into the common through holes and integrally joins the arm and the two armature members; and a core which applies a magnetic force on the armature structure to rotate the armature structure around the fulcrum shaft so as to cause a tip end of the printing needle attached to the tip end of the arm to collide with a printing medium.

* * * * *